United States Patent [19]

Foissac et al.

[11] Patent Number: 4,656,804

[45] Date of Patent: Apr. 14, 1987

[54] CYLINDRICAL MAST ELEMENT FOR END TO END ASSEMBLY WITH OTHER ELEMENTS SO AS TO CONSTITUTE A MAST

[76] Inventors: Yves Foissac, 15 rue des Lauriers, 59300 Famars; Guy Guislain, 103 Grand'rue, 59158 Maulde, both of France

[21] Appl. No.: 745,934

[22] Filed: Jun. 18, 1985

[30] Foreign Application Priority Data

Jun. 18, 1984 [FR] France ..... 84 09998

[51] Int. Cl.[4] ..... E04C 1/00

[52] U.S. Cl. ..... 52/309.16; 52/726; 52/727; 43/18.5

[58] Field of Search ..... 52/726, 727, 309.16; 43/18.5

[56] References Cited

U.S. PATENT DOCUMENTS

| | | | |
|---|---|---|---|
| 3,310,903 | 3/1967 | Binvignat | 52/726 |
| 3,613,287 | 10/1971 | Grein | 43/18.5 |
| 4,070,127 | 1/1978 | Loomis | 43/18.5 |
| 4,083,140 | 4/1978 | Van Auken | 43/18.5 |
| 4,133,708 | 1/1979 | Tokuno | 43/18.5 |
| 4,178,713 | 12/1979 | Higuchi | 43/18.5 |
| 4,362,418 | 12/1982 | Loomis | 43/18.5 |

FOREIGN PATENT DOCUMENTS

| | | | |
|---|---|---|---|
| 2393129 | 2/1979 | France | 52/726 |
| 1091195 | 11/1967 | United Kingdom | 43/18.5 |
| 1504446 | 3/1978 | United Kingdom | 43/18.5 |

*Primary Examiner*—Henry E. Raduazo

*Attorney, Agent, or Firm*—Kerkam, Stowell, Kondracki & Clarke

[57] ABSTRACT

The invention relates to a cylindrical mast element comprising a tube (2) one end (4) of which is extended by a sleeve tube (5), and each end of which has plane, inclined surfaces (7, 8). Its wall is constituted by successive coils of pieces of fabric impregnated by polymerizable resin, all of which is then polymerized.

The element has, in the zone (9) near a beveled end (6) facing the sleeve tube (5) of an adjacent coupling element and corresponding to the coupling zone (9), at least one additional piece of oriented fabric, which is disposed in such a manner that its greater strength is in the transverse direction of the mast. A plurality of elements may be joined for constructing a mast. To this end, the tubular elements are internested end to end.

16 Claims, 2 Drawing Figures

CYLINDRICAL MAST ELEMENT FOR END TO END ASSEMBLY WITH OTHER ELEMENTS SO AS TO CONSTITUTE A MAST

RELATED APPLICATIONS

This applicationis related to the following applications filed concurrently herewith:

1. "Device for Raising A Mast And Mast Raised With The Aid Of Such A Device", Jean Paul Perek, U.S. Ser. No. 745,937, corresponding to French application No. 84.10.002.

2. "Device For Wind Bracing the Members Of A Lattice Mast and Lattice Mast Provided with Said Devices", Yves Foissac, Guy Guislain, Frederic Ngo and Philippe Bertin, U.S. Ser. No. 745,940, corresponding to French application No. 84.09.999.

3. "Articulation Device Of A Mast And Mast Articulated With This Device", Guy Guislain, U.S. Ser. No. 745,933, corresponding to French application No. 84.10.001.

The subject matter of each of said related applications is hereby incorporated by reference.

FIELD OF THE INVENTION

The present invention relates to a cylindrical mast element, which can be assembled end to end with other similar elements in order to constitute a mast

BACKGROUND OF THE INVENTION

Elements of this kind which when assembled end to end constitute a mast, the end of which may support a directional apparatus, for example a projector, radioelectric antenna, camera, and so forth, are known.

For such an apparatus, it is important that the initial orientation imparted to it should be retained during the assembly of the mast and subsequently, during use, whatever the atmospheric conditions and in particular whatever the direction and force of the wind.

To accomplish this, it is known for two similar elements to be coupled end to end and mechanically locked with respect to one another, so that they will retain the relative orientation initially imparted to them.

The locking mechanism, however, has the disadvantage of being relatively complex and difficult to put into practice Elements are also known which can be assembled by coupling and the ends of which have plane surfaces which are inclined with respect to the axis of the mast.

The inclination of the contacting surfaces of two internested elements may vary between 15° and 45°, which under good conditions assures the relative rotational positioning.

Such elements are generally realized by polymerizing a thermosetting resin reinforced with fibers, for instance glass or carbon fibers.

They generally make it possible to realize a mast which assures reliable azimuth positioning of the directional element supported by the mast.

However, especially at the end in which the sleeve tube of a juxtaposed element is nested, such an element has zones of localized weakness, which are inherent in the laminar structure of the wall comprising the element.

OBJECT AND SUMMARY OF THE INVENTION

A principal object of the present invention is accordingly to overcome this disadvantage and to propose a mast element which has a reinforced structure, particularly at the end in question.

Another object of the present invention is to propose a mast element in which the longitudinal structure is likewise reinforced.

Further objects and advantages of the present invention will become apparent from the ensuing description, which is given solely by way of illustrative example, however, and is not intended to limit the invention.

According to the invention, the mast element is cylindrical and has a sleeve tube at one of its ends for engagement with the inside of the other end of a similar element.

At each of its ends, the mast element has plane surfaces inclined with respect to the axis of the mast.

The wall of the element is constituted by coiling successive pieces of fabric, impregnated with a thermosetting resin, the whole then being polymerized; at least some of the fabrics comprises fibers which are woven differently in the warp and in the weft, so that the fabric becomes stronger in one direction than in the other.

The element is characterized by the fact that with respect to the rest of the element, in a zone near its beveled end, facing the sleeve tube and corresponding to the coupling zone of a similar element, it includes at least one additional piece of fabric which has its greater strength in the transverse direction of the mast.

The invention will be better understood by referring to the ensuing description and to the accompanying drawings, which are an integral part thereof.

DESCRIPTION OF THE PREFERRED EMBODIMENT

Figure 1:
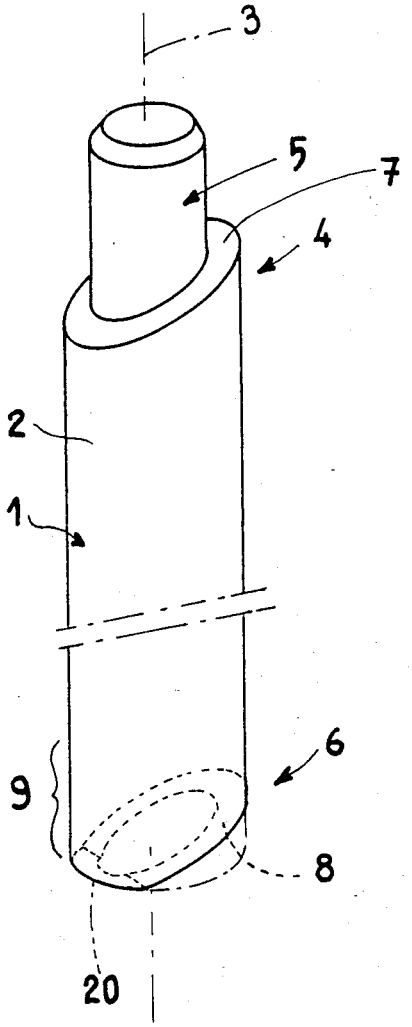
FIG. 1 is a schematic illustration of a mast element in a non-limiting embodiment for realizing the invention.

FIG. 1 shows a mast element 1, principally comprising a cylindrical tube 2 having an axis 3.

In a known manner, one of the ends of the element 1, for example the end 4, is extended by a cylindrical sleeve tube 5 integral with this end 4 and having a diameter less than that of the tube.

The reduced diameter sleeve tube 5 is intended to engage the inside of the end of another element (not shown); for this purpose, this end is similar to the end 6 of the tube 2.

Naturally the exterior dimensions of the sleeve tube 5 and the interior dimensions of the end 6 correspond to one another such that the sleeve tube 5 is capable of engagement with the inside of the end 6.

At each of its ends, the element 1 also has plane surfaces, which are inclined with respect to the axis 3 of the tube 2.

These surfaces are located at 7 and 8, respectively, in FIG. 1.

In a known manner, the contact surfaces 7 and 8 assure rotational positioning of two elements placed end to end.

Their inclination is generally between 15° and 45°.

The wall 1 is constituted by coiling pieces of technical fabric impregnated with a thermosetting resin, all of which is then polymerized.

Preferably at least some of the pieces of fabric are constituted of fibers which are woven differently in the warp and in the weft, so that they have greater strength in one direction than in the other.

Conventionally, all the pieces are oriented in such a manner that their direction of greater strength is parallel to the longitudinal axis.

According to the invention, however, as compared with the rest of the element, the zone 9 located at the beveled end 6 of the tube 2 and adapted to receive a sleeve tube 5 of an adjacent element includes at least one additional piece of fabric oriented such that its greater strength is in the transverse direction of the mast.

The zone 9 extends approximately at the level of the end 6 of the tube 2, from the contact surface 8 over a length which substantially corresponds to the depth of the coupling tube of an element placed end to end.

However, the length of the zone 9 is preferably slightly less than the depth of the coupling zone.

The addition of at least one piece of fabric so oriented, as compared with the rest of the element, improves the strength at the opening in the beveled end 6 of th element 1.

Figure 2:
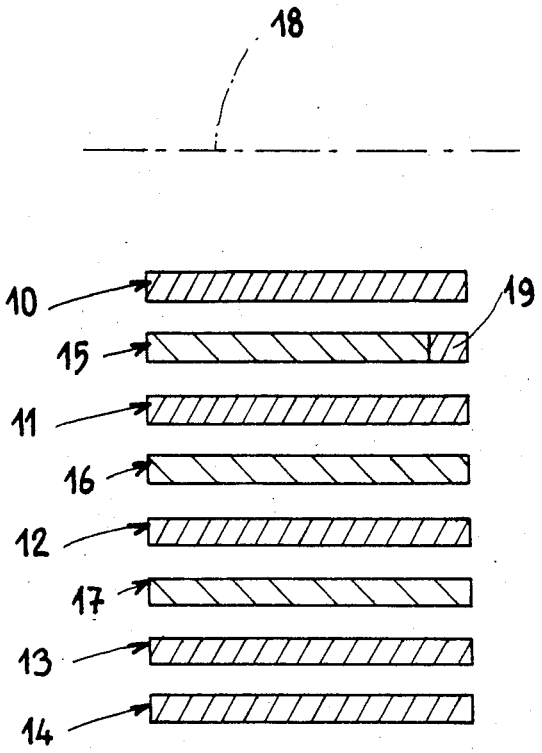
FIG. 2 is a schematic sectional view of the laminar structure of the wall of an element.

In FIG. 2, the various pieces of fabric in the structure of an element 1 are shown schematically.

In this drawing, 10–14 schematically illustrate the pieces of fabric in which the distribution of the fibers in the warp and in the weft is in balance, and which thus have equal strength in both directions.

The pieces located at 15, 16, 17 and 19 are oriented such that they have greater strength in one direction than in the other.

Among these pieces, the pieces 15, 16, 17 are oriented such that their direction of greater strength is parallel to the longitudinal axis, and the piece 19 is contrarily oriented such that its direction of greater strength is transverse to the mast axis. Also in FIG. 2, the dot-dash line 18 indicates the axis of the tube, and hence the layer 10 is the innermost layer of the wall of the tube.

As is apparent from FIG. 2, the balanced pieces and the oriented pieces preferably alternate, at least in the internal portion of the tube.

The exterior layer 14 is actually similar to the layer 13, but it is a surface layer and is not as thick.

According to a preferred embodiment for realizing the invention, the interior layer, that is, the layer 10, is a balanced layer.

The reversal of the direction of greater strength in the zone 9 of the tube 2 is realized at the level of one of the first layers having the oriented fibers, and preferably at the very first layer, that is, at the level of the layer containing piece 15.

The pieces of fabric as well as the thermosetting resin which bonds them are of some suitable quality; however, layers of glass fiber are preferably alternated with layers of carbon fiber, with the glass fiber layers being located on the surface and hence forming the interior and exterior surfaces of the wall of the tube, while the layers of carbon fiber are embedded between the layers of glass fiber.

The glass fibers actually have better resistance to shock than the carbon fibers, which are more fragile in this respect but which have superior mechanical properties and in particular have better resistance to flexing and so are extremely suitable.

According to another feature of the invention, the tubular wall has a chamfer 20 neutralizing the acute angle effected by the oblique cut; this prevents deformation of the end 6.

By way of non-limiting example, a mast element has been realized in which the length of the tube 2 is approximately 140 cm and the end of which is extended by a sleeve tube approximately 20 cm in length, and the external diameter is approximately 100 mm.

The wall of the tube 2 comprises eight pieces of fabric, with the alternation of the oriented pieces and the balanced pieces being as described in conjunction with FIG. 2.

The pieces called "balanced pieces" have approximately the same weight of warp fibers and weft fibers, but one of these, for instance the warp, may reach approximately 55% of the total weight, which quite hypothetically will be approximately 200 g per square meter.

The pieces called "oriented pieces" have a proportion of fibers in the direction of greater strength, for instance in the warp, of 89% of the total weight, which will be approximately 300 g per square meter.

Thus as has been described above, and as shown in FIG.2, the direction of greater strength in the first oriented layer, that is, at the level of the layer containing piece 15, has been reversed over a length corresponding to the zone 9 by the addition of piece 19, having a direction of greater strength transverse to the mast axis.

More precisely, this reversal has initially been effected over a length of approximately 170 mm at the time the rough tube was produced.

After the end 6 of the tube is cut so as to effect the beveling, this length has been reduced to between approximately 120 and 150 mm.

Furthermore, the extreme portion of its bevel has been chamfered.

Naturally these numerical values are furnished merely by way of non-limiting example.

The present description is provided solely by way of non-limiting example, and other variants and embodiments of the invention are possible without departing from the scope of the invention.

What is claimed isd:

1. A mast element comprising a cylindrial axial tube (2), one (4) of the ends (4,6) of which includes a sleeve tube (5) for assembly by engagement with the inside of a hollow end (6) of a similar element, the mast element having plane surfaces (7,8) at each end (4,6) inclined with respect to the axis (3) of the element and having a wall which is constituted by the polymerization of a coil of pieces of fabric impregnated with thermosetting resin, said pieces including a first plaurality of pieces of fabric having substantially equal streangth in two perpendicular directions known as the warp and the weft, and a second plurality of pieces of fabric oriented such that they have greater streangth in one direction, for example, the warp, said element having a zone (9) near a beveled end (6) adapted to engage a sleeve tube (5) of an adjacent element said zone having at least one piece of fabric (19) of the oriented type disposed such that its greater strength is in the transverse direction of the mast.

2. A mast element according to claim 1, wherein said wall has a structure constituted by alternating coiled layers of substantially balanced pieces of fabric (10–14) and layers of oriented pieces of fabric, one of said oriented pieces of fabric(15) being disposed such that its greater strength is in the transverse direction of the mast, the remainder of said oriented pieces of fabric being disposed such that their greater strength is in the longitudinal direction of the mast.

3. A mast element according to claim 2, wherein a piece (19) in the zone (9) near said beveled edge (6) is disposed with its direction of greater strength transverse to the element mast, and in the alternating arrangement of the balanced (10–14) and oriented (15–17) pieces of fabric is located in the same layer as the first piece of oriented fabric, counting outward from the axis of the mast element.

4. A mast element according to claim 1, wherein at a level of the exterior surface and of an interior surface of its wall, it has at least one piece of fabric having fibers capable of absorbing shock, while in the thickness of its wall it has at least one piece of fabric having fibers which are resistant to flexing.

5. A mast according to claim 2, wherein at a level of the exterior surface and of an interior surface of its wall, it has at least one piece of fabric having fibers capable of absorbing shock, while in the thickness of its wall it has at least one piece of fabric having fibers which are resistant to flexing.

6. A mast element according to claim 3, wherein at a level of the exterior surface and of an interior surface of its wall, it has at least one piece of fabric having fibers capable of absorbing shock, while in the thickness of its wall it has at least one piece of fabric having fibers which are resistant to flexing.

7. A mast element according to claim 1 wherein at a level of the exterior surface and of an interior surface of its wall, it has at least one piece of fabric having glass fibers, while in the thickness of its wall it has at least one piece of fabric having carbon fibers.

8. A mast element according to claim 2 wherein at a level of the exterior surface and of an interior surface of its wall, it has at least one piece of fabric having glass fibers, while in the thickness of its wall it has least one piece of fabric having carbon fibers.

9. A mast element according to claim 3 wherein at a level of the exterior surface and of an interior surface of its wall, it has at least one piece of fabric having glass fibers, while in the thickness of its wall it has at least one piece of fabric having carbon fibers.

10. A mast element according to claim 1, wherein said wall has a structure constituted by alternating coiled layers of substantially balanced pieces of fabric (10–14) and layers of oriented pieces of fabric, one of said layers of oriented pieces further comprising first and second pieces of fabric wherein said first piece (15) is disposed such that its direction of greater strength is in the longitudinal direction of the mast, and said second piece (19) being located in the zone near the beveled end of the element, is disposed such that its direction of greater strength is in the transverse direction of the mast.

11. A mast element according to claim 10, wherein said first and second pieces are located in a first layer of oriented pieces of fabric, counting outward from the axis of the mast element.

12. A mast element according to claim 10, wherein at a level of the exterior surface and of an interior surface of its wall, said element has at least one piece of fabric having fibers capable of absorbing shock, while in the thickness of its wall it has at least one piece of fabric having fibers which are resistant to flexing.

13. A mast element according to claim 11, wherein at a level of the exterior surface and of an interior surface of its wall, said element has at least one piece of fabric having fibers capable of absorbing shock, while in the thickness of its wall it has at least one piece of fabric having fibers which are resistanct to flexing.

14. A mast element according to claim 10, wherein at a level of the exterior surface and of an interior surface of its wall, said element has at least one piece of fabric having glass fibers, while in the thickness of its wall it has at least one piece of fabric having carbon fibers.

15. A mast element according to claim 11 wherein at a level of the exterior surface and of an interior surface of its wall, said element has at least one piece of fabric having glass fibers, while in the thickness of its wall it has at least one piece of fabric having carbon fibers.

16. A mast element comprising a cylindrial axial tube (2), one (4) of the ends (4,6) of which includes a sleeve tube (5) for assembly by engagement with the inside of a hollow end (6) of a similar element, the mast element having plane surfaces (7,8) at each end (4,6) inclined with respect to the axis (3) of the element and having a wall which is constituted by the polymerization of a coil of pieces of fabric impregnated with thermosetting resin, said pieces including a first plurality of pieces of fabric having substantially strength in two perpendicular directions known as the warp and the weft, and a second plurality of pieces of fabric oriented such that they have greater strength in one direction, for example, the warp, said element having a zone (9) near a beveled end (6) adapted to face a sleeve tube (5) of an adjacent element and corresponding to a coupling zone (9) of the element and said zone having at least one additional piece of fabric (19) of the oriented type disposed such that its greater strength is in the transverse direction of the mast, said element further having a chamfer on an extreme portion (20) of the beveled end (6).

* * * * *

UNITED STATES PATENT AND TRADEMARK OFFICE

CERTIFICATE OF CORRECTION

PATENT NO. : 4,656,804

DATED : April 14, 1987

INVENTOR(S) : Foissac et al

It is certified that error appears in the above-identified patent and that said Letters Patent is hereby corrected as shown below:

Column 4, line 52, delete [streangth] add --strength--.
Column 5, line 17, after "mast" add --element--.
Column 5, line 37, after "has" add --at--.
Column 6, line 18, delete [resistanct] add --resistant--.
Column 6, line 39, after "substantially" add --equal--.

Signed and Sealed this

Sixth Day of October, 1987

*Attest:*

DONALD J. QUIGG

*Attesting Officer*

*Commissioner of Patents and Trademarks*